US006584912B2

(12) United States Patent
Forbes

(10) Patent No.: US 6,584,912 B2
(45) Date of Patent: Jul. 1, 2003

(54) WELL CAR STRUCTURE

(75) Inventor: James W. Forbes, Waterloo (CA)

(73) Assignee: National Steel Car Limited, Hamilton (CA)

( * ) Notice: Subject to any disclaimer, the term of this patent is extended or adjusted under 35 U.S.C. 154(b) by 0 days.

(21) Appl. No.: 09/799,136

(22) Filed: Mar. 5, 2001

(65) Prior Publication Data

US 2001/0010198 A1 Aug. 2, 2001

Related U.S. Application Data

(63) Continuation of application No. 09/122,578, filed on Jul. 24, 1998, now Pat. No. 6,196,137.

(51) Int. Cl.[7] ..... B61D 17/00
(52) U.S. Cl. ..... 105/419; 105/404
(58) Field of Search ..... 105/355, 396, 105/404, 406.1, 407, 411, 413, 414, 417, 418, 422, 419; 296/204

(56) References Cited

U.S. PATENT DOCUMENTS

| | | | | |
|---|---|---|---|---|
| 1,696,332 A | | 12/1928 | Sheehan | |
| 3,357,371 A | | 12/1967 | Gurtridge | |
| 4,091,742 A | | 5/1978 | Cordani | |
| 4,456,413 A | | 6/1984 | Pavlick | |
| 4,599,949 A | | 7/1986 | Hill | |
| 4,648,764 A | | 3/1987 | Pavlick | |
| 4,686,907 A | | 8/1987 | Woollam et al. | |
| 4,703,699 A | | 11/1987 | Hill | |
| 4,771,706 A | | 9/1988 | Lindauer et al. | |
| 4,782,762 A | | 11/1988 | Johnstone et al. | |
| 4,862,810 A | * | 9/1989 | Jamrozy et al. | 105/355 |
| 5,054,403 A | | 10/1991 | Hill et al. | |
| 5,085,152 A | * | 2/1992 | Tylisz et al. | 105/404 |
| 5,279,230 A | | 1/1994 | Thomas et al. | |
| 5,423,269 A | | 6/1995 | Saxton et al. | |
| 5,465,670 A | | 11/1995 | Butcher | |
| 5,520,489 A | * | 5/1996 | Butcher et al. | 105/355 |
| 5,743,191 A | | 4/1998 | Coslovi | |
| 6,003,445 A | * | 12/1999 | Coslovi et al. | 105/355 |

* cited by examiner

*Primary Examiner*—Mark T. Le
(74) *Attorney, Agent, or Firm*—Hahn Loeser + Parks LLP; Stephen L. Grant

(57) ABSTRACT

A railcar unit has a pair of opposed side sills that are joined by structure that performs the function of a web in a deep beam or bracing in a truss. The joining structure is able to transmit loads that are applied transversely to the longitudinal direction of the car from one sill to the other, and is also able to transmit a bending moment couple, in the form of opposite longitudinal tensile and compressive forces, also transmitted to the side sills. The locations at which the transverse forces are imposed on, or by, the intermediate structure have longitudinal slip. When the railcar unit is placed in longitudinal tension under draft loads, the longitudinal slip allows the floor structure not to be subject to the longitudinal draft loads. In the embodiment described the joining structure serves the additional function of acting as a floor panel for vertical loads carried within the well car unit.

42 Claims, 16 Drawing Sheets

102
104
112
124
116
120
126
114
82
118
106
108
110

WELL CAR STRUCTURE

This application is a continuation of application Ser. No. 09/122,578, filed on Jul. 24, 1998, now U.S. Pat. No. 6,196,137.

FIELD OF THE INVENTION

This invention relates to improvements in the structure of well cars, and in particular to a resistance to lateral loads through an improved floor design.

BACKGROUND OF THE INVENTION

Railway well cars may be considered as upwardly opening U-shaped channels of a chosen length, simply supported on a pair of railcar trucks. Although single unit well cars are still common, there has been a trend in recent years toward articulated, multi-unit railcars which permit a relatively larger load to be carried on fewer railcar trucks.

Contemporary well cars may carry a number of alternative loads made up of containers in International Standards Association (ISO) sizes or domestic sizes, and of highway trailers. The ISO containers are 8'-0" wide, 8'-6" high, and come in a 20'-0" length weighing up to 52,900 lbs., or a 40'-0" length weighing up to 67,200 lbs. Domestic containers are 8'-6" wide and 9'-6" high. Their standard lengths are 45', 48' and 53'. All domestic containers have a maximum weight of 67,200 lbs. Recently 28' long domestic containers have been introduced in North America. They are generally used for courier services which have lower lading densities. The 28' containers have a maximum weight of 35,000 lbs.

Two common sizes of highway trailers are, first, the 28' pup trailer weighing up to 40,000 lbs., and second, the 45' to 53' trailer weighing up to 60, 000 for a two axle trailer and up to 90,000 lbs. for a three axle trailer. It is advantageous to provide well cars with hitches at both ends. This permits either a single 53' three axle trailer to be loaded in either direction, or two back-to-back 28' pup trailers to be loaded.

The wheels of a trailer can rest in the well, with the front, or nose of the trailer overhanging the car end structure at one end or the other of well car unit. A second trailer may rest in the well facing in the opposite direction. Alternatively, shipping containers, typically of 20 ft., 28 ft, or 40 ft lengths may be placed in the well, with other shipping containers stacked on top. Further, well cars may carry mixed loads of containers and trailers.

Whichever the case may be, a well car is required to withstand three kinds of loads. First, it must withstand longitudinal draft and buff loads inherent in pulling or pushing a train, particularly those loads that occur during slack run-ins and run-outs on downgrades and upgrades. Other variations of the longitudinal load are the 1,600,000 lbs. squeeze load and the 1,250,000 lbs. single ended impact load. Second, the well car must support a vertical load due to the trailers or shipping containers it carries. Third, it must be able to withstand lateral loading as the well car travels along curves and switch turn-offs. It is important to carry these structural loads while at the same time reducing the weight of the railcars themselves, first to permit a greater weight of freight to be carried within the overall maximum car and load weight limit, and second to reduce the amount of deadweight that must be pulled when the car is empty. Third, a lighter car may be less costly to build.

The U-shaped section of the car is generally made up of a pair of spaced apart left and right hand side beams, and structure between the side beams to support whatever load is placed in the well, and to carry shear between the sills under lateral loading conditions.

In earlier types of well car the side sills tended to be made in the form of a single, large, beam. While simple in concept, they were often wasteful, having an unnecessary amount of material in locations where stress may have been low. It is advantageous to have a sill in the form of a hollow section, of relatively thin walls, and to provide local reinforcement where required. It is also desirable that the hollow section be as manufactured at the mill, whether as tube or roll formed section, if possible, rather than welded. This often yields a saving in effort, may permit the use of a higher yield stress alloy, and may also reduce the number of defects or stress concentrations in the resulting structure. As the wall thickness decreases the prospect of buckling under buff loads and vertical loads increases, and measures to deter buckling would be advantageous. It would also be advantageous to provide protection for the sills to discourage damage to the sills due to clumsy loading of trailers or containers.

In the past, one method of dealing with areas of higher flange stresses in the side construction was to use a member of greater weight. As the thickness of structural members is reduced it would be advantageous to transfer loads from the railcar trucks to the bolsters, and thence to the side sills, more smoothly to discourage or reduce stress concentrations. One way to do this is to increase the depth of section at the bolster, with a consequent increase in height of the end decking.

SUMMARY OF THE INVENTION

The present invention provides, in a first aspect, a transverse force resolver for a railcar having a pair of longitudinally extending side sills, comprising a structure having one longitudinal force transfer interface for transferring force to one side sill and another longitudinal force transfer interface for transferring force to the other side sill. A transverse force transfer interface is provided for transmitting a transverse force to one of the side sills. The transverse force transfer interface is offset from the one longitudinal force connection by a longitudinal moment arm distance. The transverse force transfer interface has longitudinal slip.

Additionally, that aspect of the invention may be such that the longitudinal force connections are structurally equivalent to a pin jointed connections. Also, additionally, in that first aspect of the invention the longitudinal connections can be for location at substantially the same longitudinal location of the railcar. In yet another additional feature of that aspect of the invention the force resolver can comprise another transverse force connection for transmitting a force to the other side sill, and the other transverse force connection is offset from the longitudinal force connection by another longitudinal moment arm distance.

In a different additional feature of that aspect of the invention, the force resolver can include a cross beam and a moment structure mounted thereto. The longitudinal force connections are located at opposite ends of the beam. The moment structure extends away from the beam; and the transverse force connection is mounted to the moment structure.

In yet another additional feature of that aspect of the invention, the force resolver transverse force connection can include an abutment for abutting a reaction member mounted to the side sill. In a still further alternative feature of that aspect of the invention, the force resolver can include abutments for abutting reaction stops for transmitting clockwise and counterclockwise moments to the longitudinal force connections. And, in each case, the force resolver moment structure can be a floor panel of the railcar.

In another aspect of the invention, there is a transverse force resolver for a railcar having a pair of longitudinally extending side sills, comprising a structure having a longitudinal force connection for connection to one of the side sills, and a pair of transverse force transfer interfaces for transmitting transverse forces to the side sills. One of the transverse force transfer interfaces is offset from the longitudinal force connection by a longitudinal moment arm distance; and the transverse force transfer interfaces have longitudinal slip.

In an additional feature of that aspect of the invention, the transverse force resolver is for a railcar having a pair of spaced apart cross beams extending between and connected to the side sills, wherein each of the transverse force connections is mountable to one of the cross beams.

In another aspect of the invention, there is a rail car having a pair of longitudinally extending side sills. A pair of spaced apart cross beams extend between and are connected to the side sills. A pair of force resolvers, as described in the previous aspect of the invention, each have one of the transverse force connection mounted to one of the beams, and the other of the transverse force connections mounted to the other of the beams. One of the force resolvers has its longitudinal force connection connected to one of the side sills and the other of the force resolvers has its the longitudinal force connection connected to the other of the side sills.

In a still further aspect of the invention there is a transverse force resolver for installation between a pair of longitudinally extending side sills of a railcar, comprising a pair of longitudinal force connections, one connected to one of the side sills and the other connected to the other of the side sills. A pair of transverse force transfer interfaces are provided for transmitting transverse forces to the side sills. Each of the transverse force transfer interfaces is offset from the one of the longitudinal force connections by a longitudinal moment arm distance, and each of the transverse force transfer interfaces has longitudinal slip.

In an additional feature of these aspects of the invention the transverse force resolver can have longitudinal force transmitting interfaces chosen from the set of connections consisting of (a) a bolted connection; (b) a pin jointed connection; (c) a welded connection; (d) a rivetted connection; and (e) a sliding connection with transverse slip. Similarly, in an additional feature of these aspects of the invention, the transverse force connections have abutments for transmitting forces to either side of the rail car.

In a further additional feature of any of the above aspects of the invention, the transverse force resolver can include a cross beam having longitudinal force connections at either end thereof and a pair of mounted structures attached to transmit a moment thereto. One of the mounted structures extends longitudinally forwardly and the other extends longitudinally rearwardly therefrom. Each of the mounted structures has one of the transverse force connections mounted thereto. In a yet further additional feature of that additional feature, the transverse force resolver includes a pair of the mounted structures that extend forwardly of the cross beam and a pair of the mounted structures extend rearwardly of the cross beam. Each of the mounted structures have one of the transverse force connections mounted thereto.

In a still further aspect of the invention, there is a floor panel assembly for a railcar having a pair of longitudinally extending side sills, comprising a first cross member extending between and connected to the side sills, and a moment arm structure mounted to the cross member for transmitting a moment thereto. The moment arm extends away from the cross member and has a transverse force transfer interface for transmitting a transverse force to one of the sills. The transverse force transfer interface having longitudinal slip.

In an additional feature of this aspect of the invention, the floor panel assembly can extend substantially perpendicular to the side sills. In another additional feature of this aspect of the invention, the floor panel assembly includes a second moment arm structure. The first moment arm structure extends longitudinally forwardly from the cross member and the second moment arm structure extends rearwardly thereof. The second moment arm structure has a transverse force connection, having longitudinal slip, for transmitting a force to the other side sill.

In yet a still further aspect of the invention, there is a well car comprising a pair of spaced apart, longitudinally extending side sills. A floor cross member extends between and is connected to the side sills. A moment arm structure is connected to the cross member for transmitting a moment thereto. The moment arm having a transverse force transfer interface for transmitting force to one of the side sills, and the transverse force transfer interface has longitudinal slip.

In an additional aspect of that invention, the well car can include a floor cross beam that extend between, and is connected to, the side sills, spaced from the cross member. The transverse force connection is mounted to the cross beam to transmit force to the one side sill through the beam.

In another additional feature of that aspect of the invention, the well car can further comprise another cross beam extending between and connected to the side sills, spaced apart from the one the cross beam. The cross member is located between the cross beams and another moment arm structure connected to the cross member for transmitting a moment thereto. The other moment arm structure has a transverse force connection to the other cross beam, and the other transverse force connection has longitudinal slip.

BRIEF DESCRIPTION OF THE DRAWINGS

For a better understanding of the present invention and to show more clearly how it may be carried into effect, reference will now be made by way of example to the accompanying drawings, which show an apparatus according to the preferred embodiment of the present invention and in which.

DETAILED DESCRIPTION OF THE PREFERRED EMBODIMENT

Figure 1A:
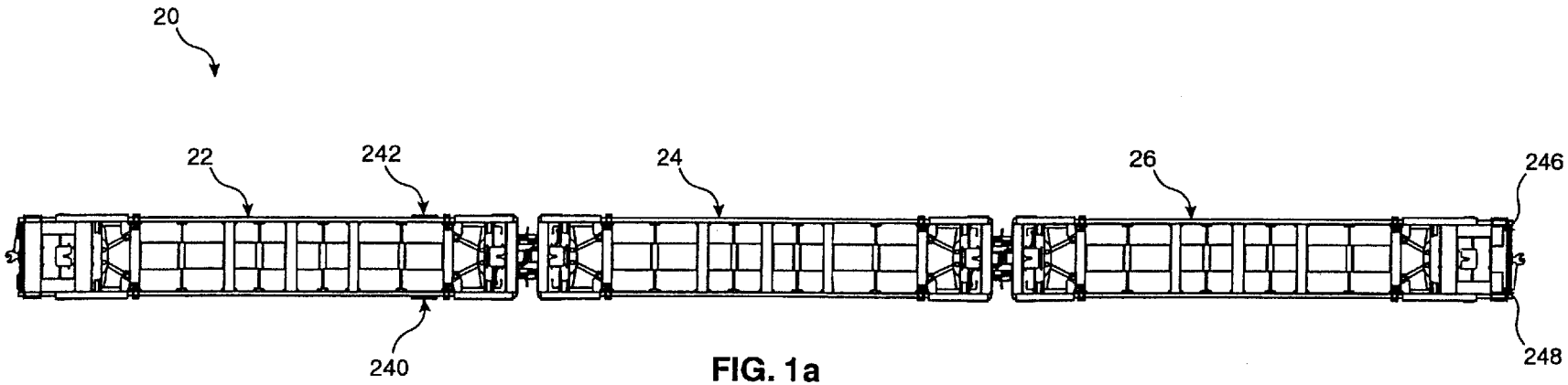
FIG. 1*a* is a plan view of an articulated railcar having three articulated well car units.
Figure 1B:
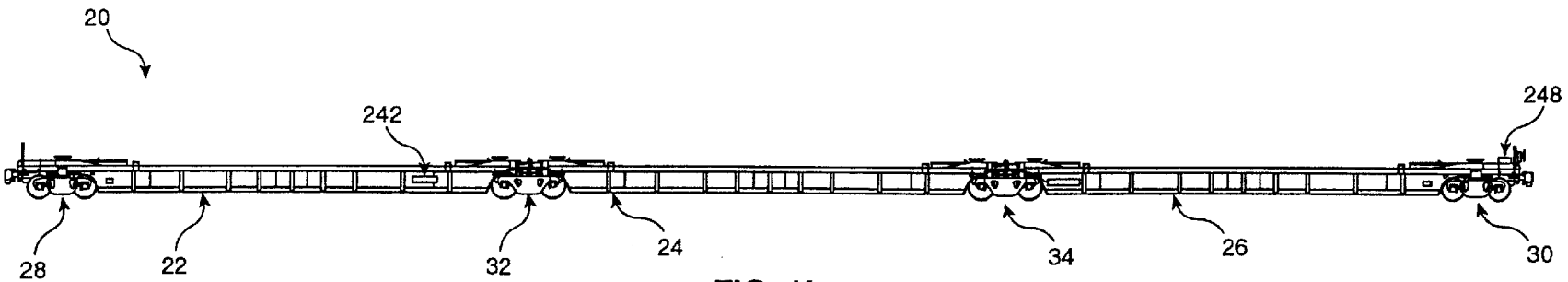
FIG. 1*b* is a side view of the articulated railcar of FIG. 1*a*.

The description of the invention is facilitated by commencing with reference to the Figures, in which some proportions have been exaggerated for the purposes of conceptual illustration. Referring to FIGS. 1*a* and 1*b*, an articulated rail car is shown generally as 20. It is made up of three articulated well car units, a first end unit 22, an intermediate unit 24 and a second end unit 26 supported on a pair of standard end trucks 28 and 30, and a pair of articulated trucks 32 and 34 located between units 22 and 24, and between units 24 and 26 respectively.

The mechanism for resolving transverse shear force loads will be described generally and in a typical manner, with the aid of FIGS. 1*c* and 1*d*, and the loading schematics of FIGS. 2*a*, 2*b* and 2*c*. A more detailed structural description and variations will follow after the general conceptual description. End unit 22 has a connector end structure, indicated generally as 36, an articulated end structure indicated generally as 38, and a well structure, indicated generally as 40 extending between them. Well structure 40 has a pair of opposed side members in the nature of left and right hand longitudinal beam assemblies 42 and 44, held apart by a floor assembly 50.

Figure 2A:
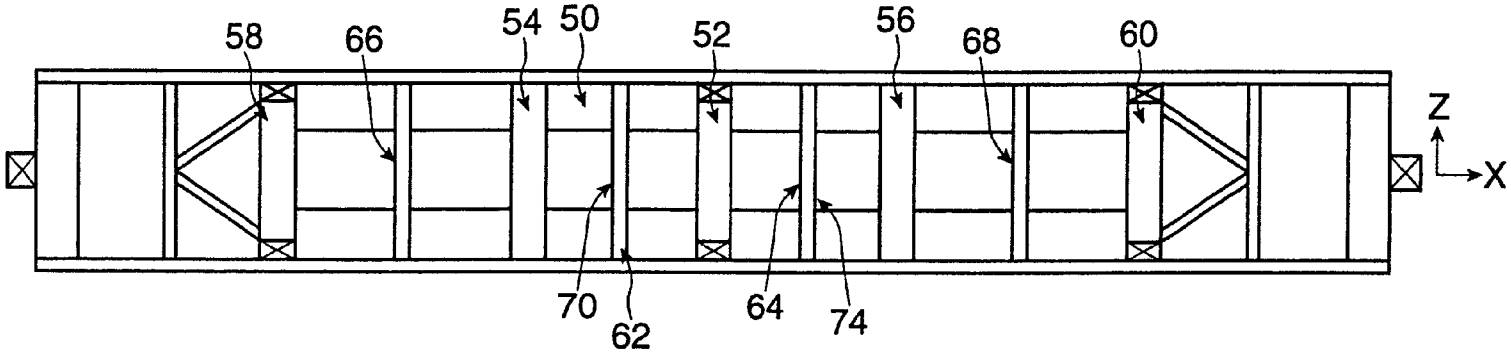
FIG. 2*a* is a schematic plan view of an unloaded end unit as in FIG. 1*c*.
Figure 2B:
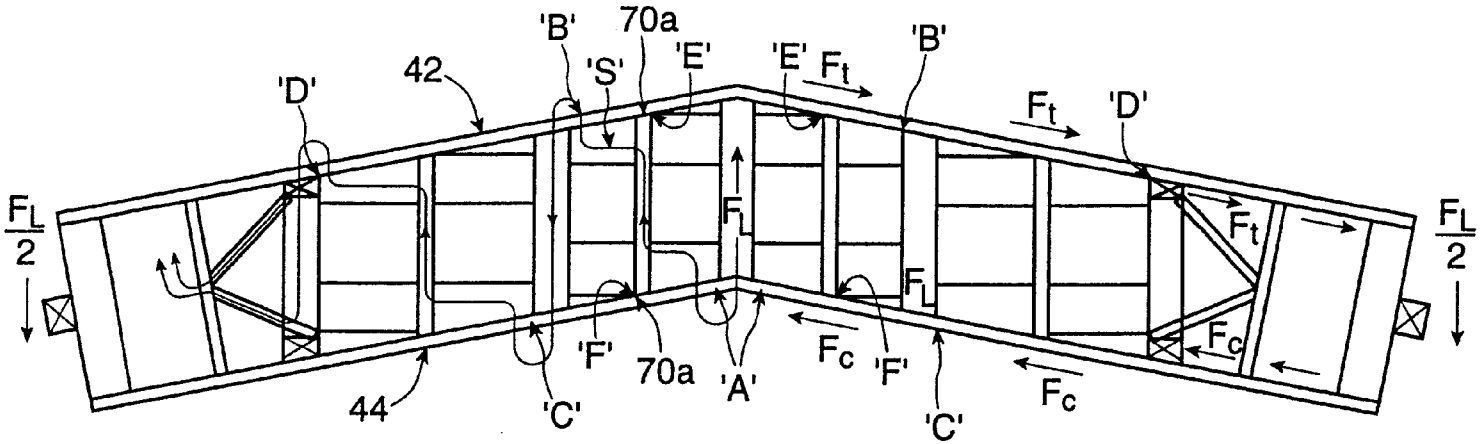
FIG. 2*b* is a schematic plan view of a laterally loaded end unit as in FIG. 1*c*.

When a lateral load, $F_L$ is applied, as for example when unit 22 travels through a curve, there will be a tendency for beam assemblies 42 and 44 to deflect, as grossly exaggerated in the schematic of FIG. 2*b*. For the sake of simplifying this conceptual description, load $F_L$ is shown as a single point load at the mid point of unit 22. In actual use lateral loads would be applied to unit 22 at each location at which a load rests on unit 22, such as the container supports. However, the same concepts described would continue to apply. $F_L$ could typically be the lateral force imparted on a container or a trailer (carried through its wheels). For the purposes of conceptual explanation it is shown as being applied at a central cross beam such as cross beam 52 of floor assembly 50. Other cross beams include a pair of medial cross beams are shown as 54 and 56 and a pair of end cross beams 58 and 60. Initially, in the unloaded condition, all cross members are at 90 degrees to the lower side sills of beam assemblies 42 and 44. This defines right-angled rectangular areas in the floor, as in FIG. 2*a*. Conceptually, were the structure to deflect laterally, without the flooring in place, the rectangles would deform into the parallelogram shape shown in FIG. 2*b*.

While the general shape of the bays of the floor changes to a parallelogram configuration, the arms of H-shaped force resolvers 62 and 64, continue to extend outwardly at right angles from cross member 70. Consequently, the deflection due to $F_L$ will cause H-shaped force resolvers 62 and 64 of floor assembly 50 to bind against beam assemblies 42 and 44 in the regions indicated as "A" and "B" respectively. The binding at "A" provides a direction reaction for $F_L$ on cross member 70. The binding faces are in compression at "B", and thereby transmit a force into side beam assemblies 42 and 44. The reaction to this force is provided by the adjacent horizontal cross beam 54 or 56, which is placed in tension. Once again, the shear in beam assemblies 42 and 44 will cause the neighbouring H-shaped force resolver 66 to bind against side sill assemblies 42 and 44 in the regions indicated as "C" and "D", and so on, until the shear is carried all the way to end structures 36 and 38 for ultimate reaction by the counter plate which sides on the railcar trunk.

It will be noted that force resolver 62 is subject to a force couple, or moment, M=a(FL/2) due to the forces transmitted at regions "A" and "B". This moment is resisted by the bolted longitudinal force connection of force resolver cross member 70 at locations "E" and "F" to side beam assemblies 42 and 44 respectively, whose sum is equal to the product of the longitudinal forces transferred from the side sills, each Fs, multiplied by the moment arm, each being b/2 for a total of 2(Fs)(b/2)=Fs(b). In this manner the transverse force applied at "A" is reacted by a transverse force at "B", plus a tensile longitudinal force, FT in assembly 42, and a compressive longitudinal force, FC, in the opposite direction in assembly 44. Since force resolver 62 does not rotate in space, the moment couple of the forces transferred to and from assemblies 42 and 44 at locations "E" and "F" multiplied by the width between assemblies 42 and 44, is equal and opposite to the moment couple of the forces applied at "A" and "B" multiplied by the longitudinal moment arm distances defined by the longitudinal separation of the effective centers of, for example, "A" from "E" and "B" from "E". In the specific example shown these latter distances are each equal and are more or less b/2, the longitudinal half width of force resolver 62.

Force resolver 62 is not under longitudinal tensile stress. When railcar unit 22 stretches longitudinally due to draft loading or due to the tension in the side sill due to vertical loading, or both, the connection, or transverse, force interfaces, at "A" and "B" have longitudinal slip, so that large tensile forces can not build up due to tensile strain, or displacements in the side sill from vertical and draft loads.

The bolted connections at "E" and "F" can be thought of as approximating, or being roughly equivalent to, pin jointed connections for the purposes of conceptual structural analysis. This approximation will remain true provided that the width, that is, the longitudinal extent of the bolted connection, is small relative to the overall size of the "H" shaped force resolver. That is, in general the moment defined by the forces transmitted at "C" and "D" multiplied by their moment arms is large, or very large, relative to any moment due to twisting at the bolted connections at "E" and "F". Furthermore, even that twisting is limited when cross member 70 is connected at both ends to side beam assemblies 42 and 44. Ideally, the bolted connections at "E" and "F" should transmit a purely shear force which causes either tension or compression in longitudinally extending side sill assemblies 42 and 44. Further, the approximation would remain true even if connection were a pin joint or a welded connection. A bolted connection has advantageous fatigue performance and is preferred. Bolting also makes it possible to remove and replace damaged cross members relatively easily.

The structure of well car unit 22 will now be described in detail, commencing with the structure of floor assembly 50, followed by side beam assemblies 42 and 44, and end structures 36 and 38. For the purposes of the present disclosure the floor assemblies shown are all the same, whether considering the multiple unit articulated railcar of FIGS. 1*a* and 1*b*, or the single unit well car of FIG. 1*c* and 1*d*.

Referring to floor assembly 50 of unit 22, the spacing between main cross beam 52 and 28' medial cross beams 54 and 56 is unequal to the spacing between 28' medial cross beams 54 and 56 and 40' end cross beams 58 and 60. Four ISO 40' container cones located on 40' cross beams 58 and 60 are indicated as 72. The unequal pitch of the cross members is such that the well structure 40 can accommodate either two ISO 20' containers, each with one end located on cones 72, a single 40' ISO container, also located on cones 72, a single 45' domestic container or a single 48' domestic container. Depending on the configuration of container carried in well structure 40, unit 22 is designed also to support an upper, stacked 40' ISO container, or single stacked 45', 48' or 53' domestic containers.

Force resolver cross members 70, 74, 76, and 78 are located midway between each successive pair of cross beams. They have either short floor panels, left handed ones designated as 80 and right handed ones as 82, or long floor panels, left and right handed ones designated as 84 and 86, respectively, welded to them as described in greater detail below. Four floor panels are generously welded to each cross member to form the H-shape shown. At each end of floor assembly 50 there is a pair of load spreading struts 88 and 90. They transfer longitudinal loads between end structures 36 and 38 and side beam assemblies 42 and 44 through end cross beams 58 and 60. Left and right hand cross beam socket fittings 92 and 94 receive the ends of struts 88 and 90, as also described in greater detail below. Finally, at either end of floor assembly 50 left and right hand floor panel extensions 96 and 98 are located between socket fittings 92 and 94 and side beam assemblies 42 and 44. Floor panel extensions 96 and 98 permit a 53' trailer to be carried in well structure 40.

As noted above, force resolver 62 is made of cross member 70 and floor board panels 80 and 82. Referring now to FIGS. 3*a*, 3*b*, 3*c*, and 3*d*, whether long or short, the construction of floor panel 82 is typical of all floor panels. For carrying a load it has a top plate 102, having a welded edge 104, for welding to cross member 70, and a free edge 106 for locating freely slidably against cross beam 54 or 56 (as the case may be). A pair of spaced apart, parallel, longitudinally extending channels 108 and 110 are welded, toes up, to the underside of top plate 102. Channels 108 and 110 extend between and terminate at a welded edge cross member end support plate 112 which depends from top plate 102 near welded edge 104, and a free edge cross member support plate 114 which depends from top plate 102 near free edge 106. A floor panel side support 116 lies generally in a shallow arc along, and is spaced inboard from, the longitudinal side sill edge 118 of top plate 102. An abutment, in the nature of a generously welded floor panel corner tab 120, is welded to the underside near a cross beam cut-out 122, and top plate 102 has an upturned lip 124 for facing beam assembly 42 (or 44, as may be). A thrust block 126 is welded to the inboard corner, longitudinal end face of top plate 102 to bear against cross beam 54 or 56, as is described below.

Cross member 70 has a downwardly opening channel 130 whose toes terminate at a closure plate 132 that is welded to channel 130 to form a closed box section. Closure plate 132 extends beyond channel 130 to leave horizontal flanges 134 for accommodating, and carrying, the downward face of free edge support plate 114. Cross member 70 terminates at each end with end flanges 136 having a vertical face 138 for fastening with bolts to side beam assembly 42 (or 44), and a pair of horizontal ears, 140 for bolted connection to the toe of an angle iron of that side sill.

Cross beam 52, being typical, is made of a downwardly opening channel 146. A closure plate 148 is welded across the toes of channel 146 to form a box section, as above, with fore and aft extending horizontal flanges 150 for supporting welded edge end support plate 112. It also has cast end flanges, 152, for bolted connection to side beam assemblies 42 and 44 at six places per flange—four on a vertical face 154 and two on opposed ears 156 for engagement with the toe of an angle iron of side beam assemblies 42 and 44 as the case may be.

Figure 6A:
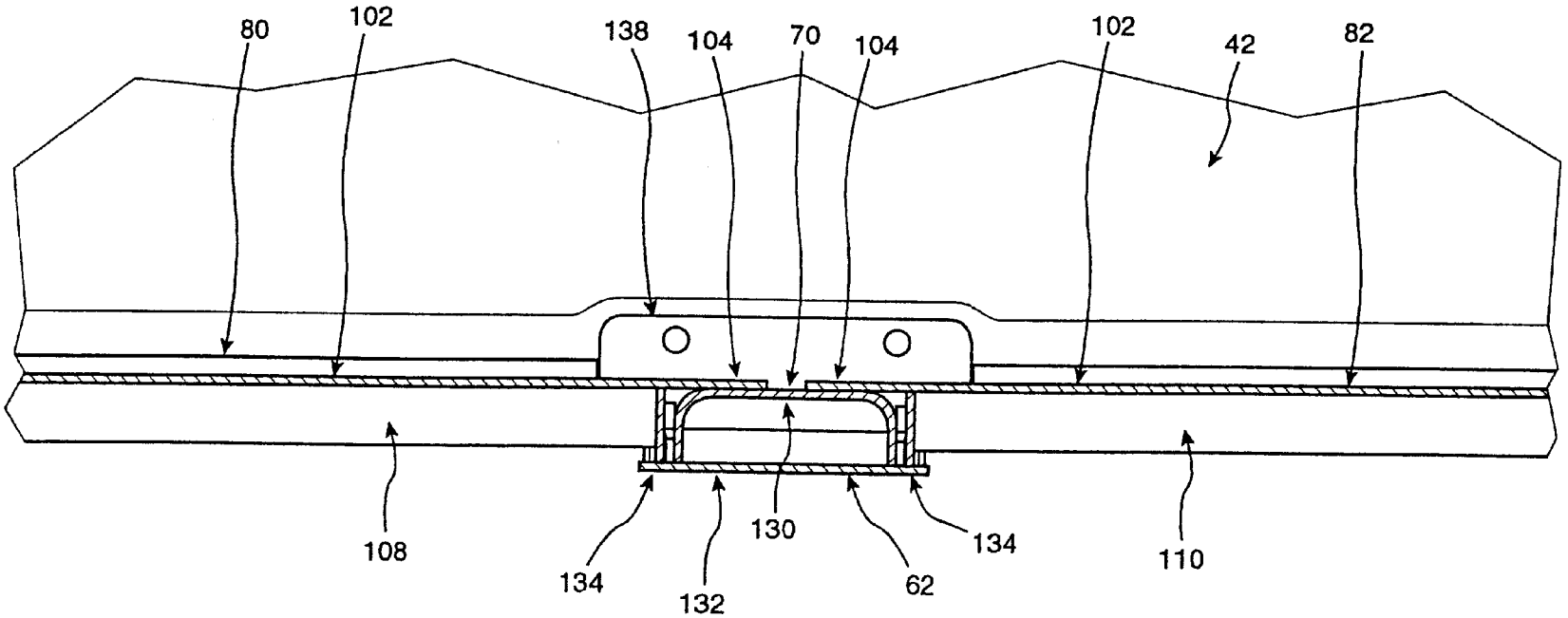
FIG. 6*a* shows a typical cross section of a pair of floor panels welded to a spine as indicated at cross section '6*a*—6*a*' of FIG. 1*c*.
Figure 6C:
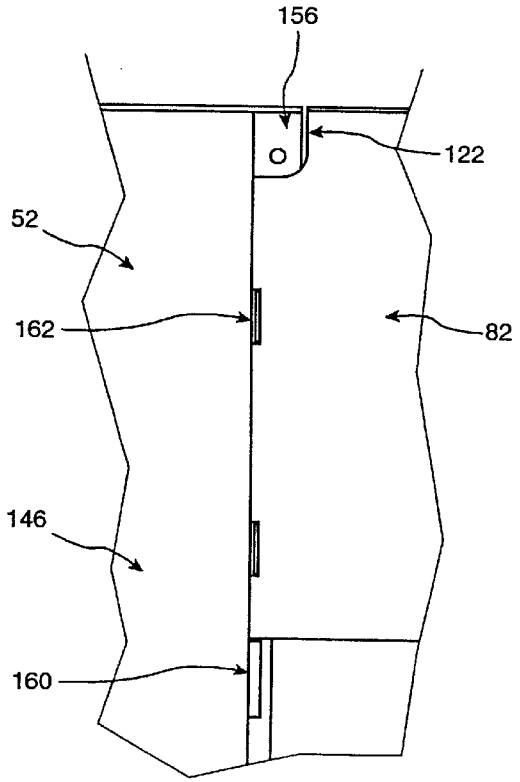
FIG. 6*c* shows a view on Arrow '6*c*' of FIG. 6*b*.
Figure 6B:
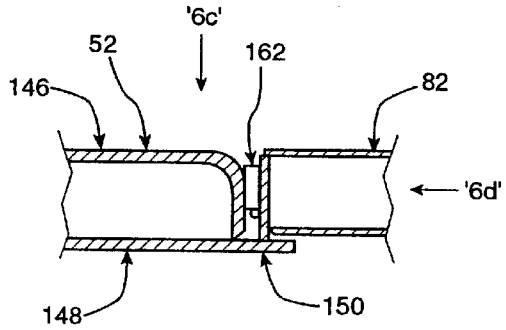
FIG. 6*b* shows a typical cross section of an interface between a floor panel and a cross beam as indicated at cross section '6*b*—6*b*' of FIG. 1*c*.
Figure 6D:
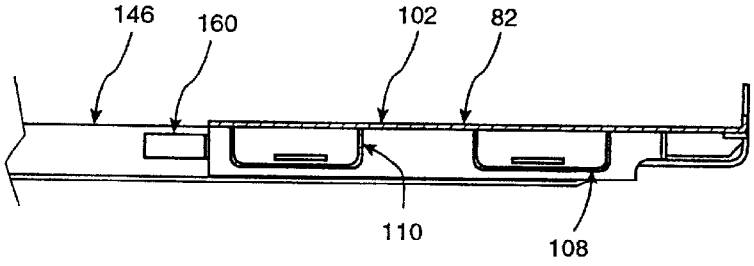
FIG. 6*d* shows a view on Arrow '6*d*' of FIG. 6*b*.

On assembly, floor panels 82, 84, 86, and 88, as the case may be, are not welded to flanges 152, but are allowed to be located freely thereon. Floor panels 82, 84, 86, and 88 are located with corner tab 120 snug against beam assembly 40 (or 42) which acts as a stop. Once in place, side reaction blocks 160 are generously welded to the vertical side faces of channel 146 as shown in FIG. 6*c*. In this position one end face of each block 160 acts as a stop hard against thrust block 126. Thus the distal ends of floor panels 82, 84, 86, and 88, while not attached to channel 146, are prevented from moving laterally by the inboard face of beam assembly 40 or 42 in one direction, and by thrust block 126 in the other direction and so a slip joint, or slip connection is formed that not only has slip in the longitudinal direction but also has a transverse force transfer interface for transmitting transverse force to either side beam assembly 42 or 44 either directly or through the force transfer medium cross beam 54, 56 or some other cross beam as the case may be. Floor panels 82, 84, 86, and 88 are also restrained longitudinally by shims 162, of the largest possible dimension, fit on assembly between the vertical side face of channel 146 and support plate 112. Top plate 102 has cut-outs to permit installation of shims 162. The box section formed by closure plate 148 provides cross member 52 with resistance to deflection under longitudinal compressive loads such as may be imposed by floor panels 82, 84, 86, and 88.

Referring again to the conceptual illustrations of FIGS. 2*a* and 2*b*, the initially rectangular bays mentioned above are defined by longitudinally extending side beam assemblies 42 and 44, and by transversely extending cross beam pairs, such as, for example, beams 54 and 58. Taking the lateral force once again as $F_L$, and assuming that half or this force is carried to each of trucks 28 and 32, as, for example, upon the shear flow path indicated as 'S', then the force transferred at each of stops 160 and corner tabs 120 is nominally one quarter of $F_L$. In actual use the precise values of the forces transferred will depend on the placement of the loads and the relative stiffness of the various load paths. Lateral loading from either side of the car will produce a tensile load in cross beams 54 and 58. The load is carried across the bolted interface at the end of each beam, to the respective side sill, and then to the adjacent floor panel, or panels in the case of assemblies having stops 160.

Figure 7A:
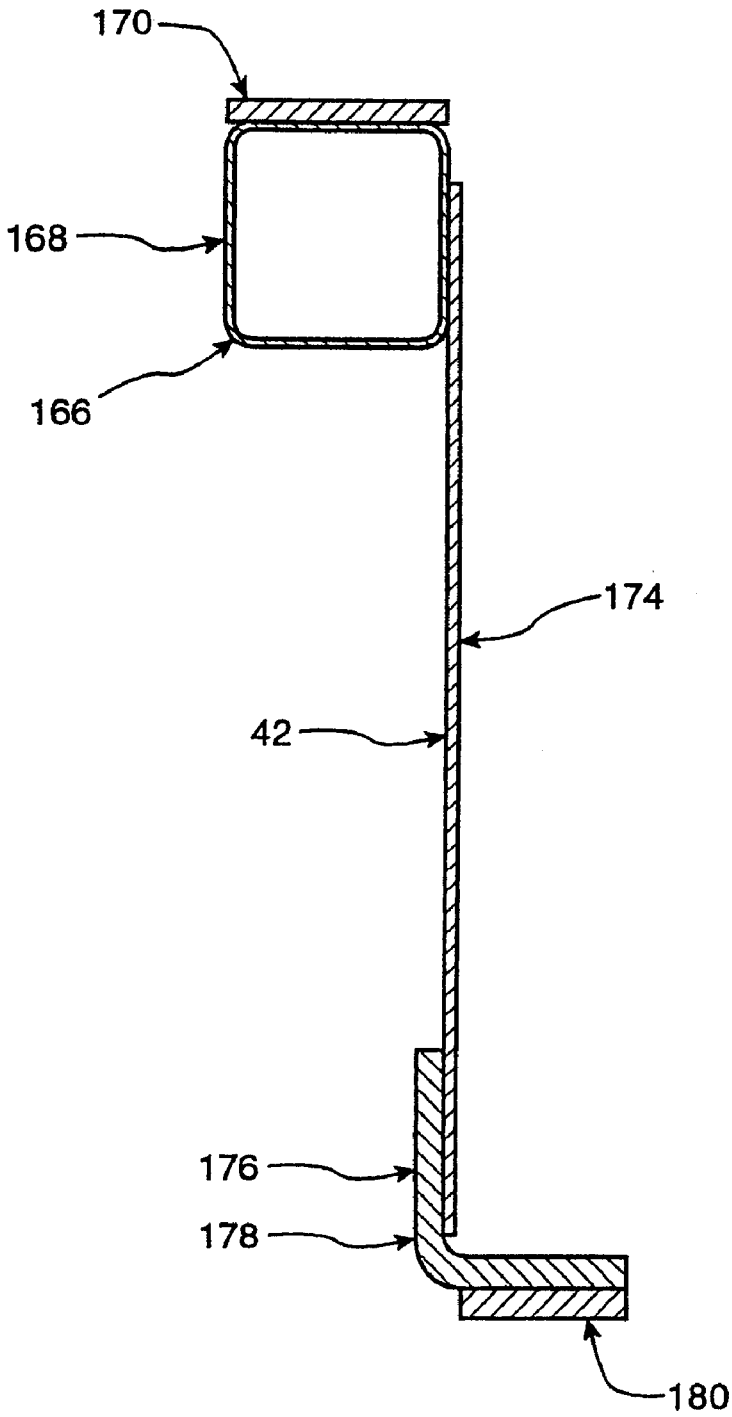
FIG. 7*a* shows a section of a side beam of the end unit of FIG. 1*d* taken on '7*a*—7*a*'.

A section of side beam assembly 42, identical to side sill assembly 44, taken in the region of maximum vertical bending moment at section '7*a*—7*a*' is shown in FIG. 7*a*. It has a top chord member 166 in the form of a generally square or rectangular hollow tube 168, typically with a ¼" or 5/16" wall thickness, surmounted by a 1" thick top chord plate 170, with fillet welds all along the edges. At each section 'X—X', shown in FIG. 1*d*, plate 170 is supplanted by a thinner, ½" thick plate 180. Returning to FIG. 7, a web 174 is mounted to and extends downwardly from the inner face of hollow tube 168 to meet lower side sill 176 in the form of a ½" thick roll formed angle 178 having a 7⅜" vertical leg and a 7" inwardly extending toe. A ½" thick reinforcement 182 is welded to the lower face of the toe of angle 178. Stiffeners in the nature of side posts 162 in the form of steel channel sections, are welded, toes inward, intermittently along the outside face of side sill assembly 42 at locations corresponding to the junctions of cross beams, such as cross beam 52, and spines such as cross member 70.

Figure 7B:
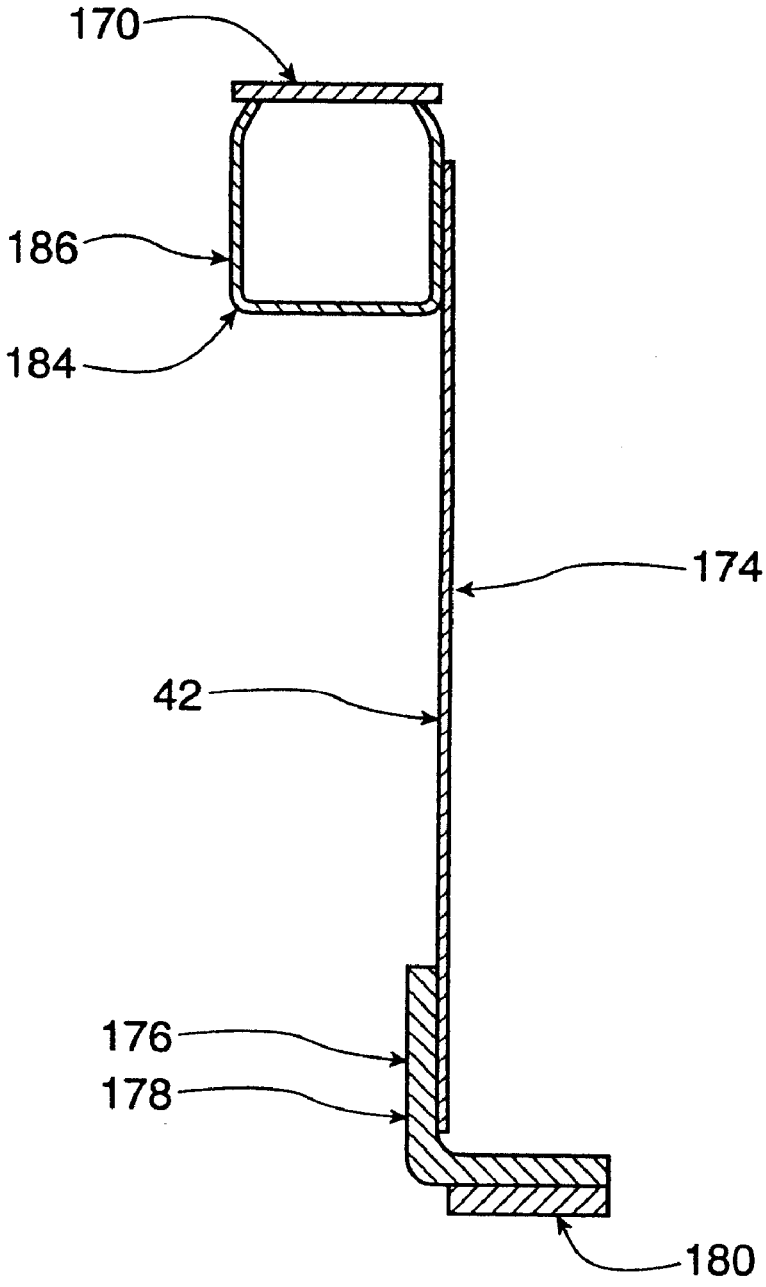
FIG. 7*b* shows an alternate section to that shown in FIG. 7*a*.

In an alternate embodiment, shown in FIG. 7*b*, a top chord member 184 has an upwardly opening roll formed, U-shaped channel 186 in place of tube 168. The toes of channel 186 are welded to the underside of plate 170 (or 180 as the case may be), to yield a closed hollow section.

Figure 8:
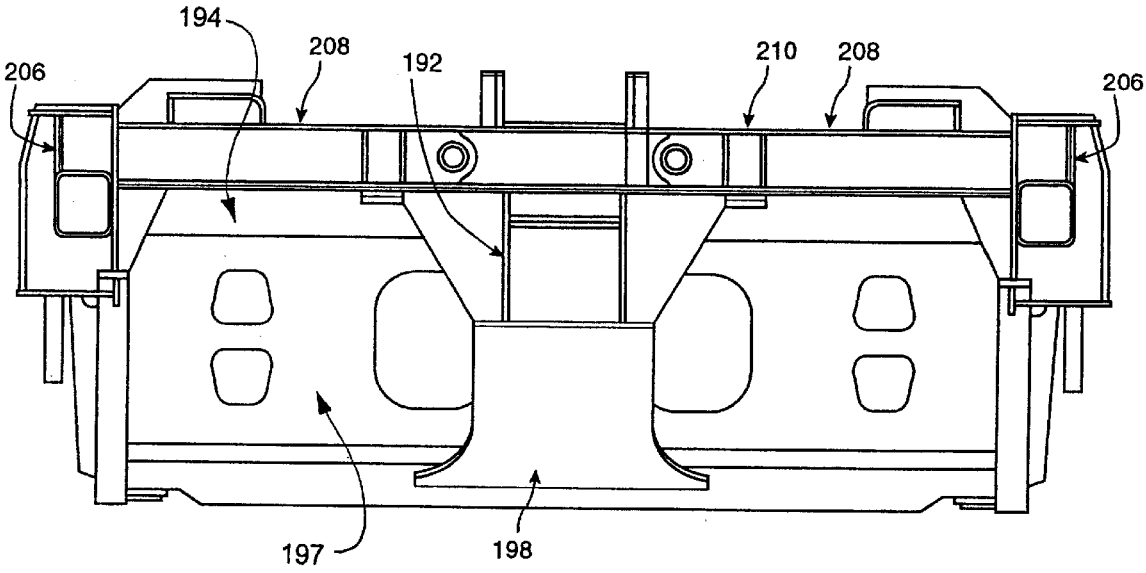
FIG. 8 shows an end view of the articulation end of the end unit of FIG. 1*c*.
Figure 9A:
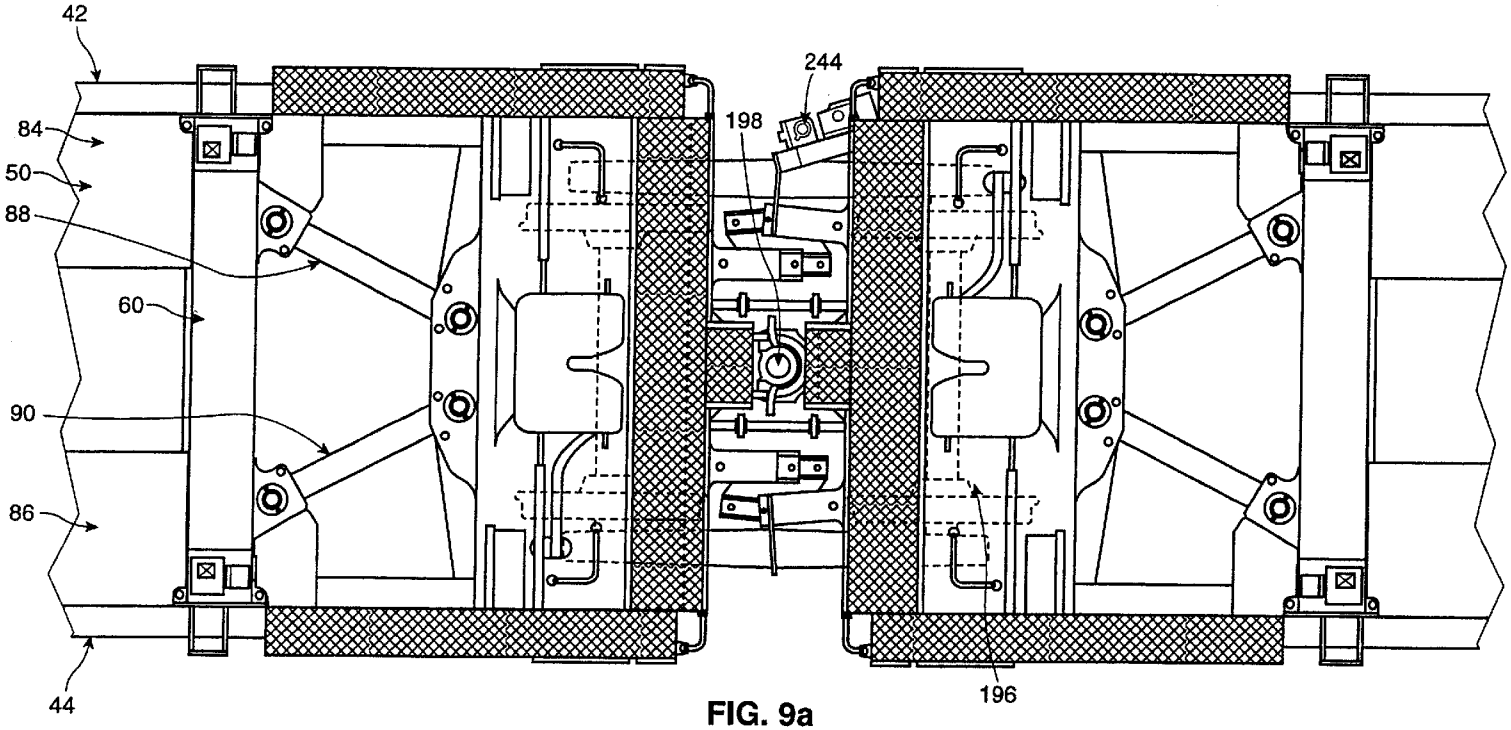
FIG. 9*a* is an enlarged detail, in plan view of an articulated connection of the railcar of FIG. 1*c*.
Figure 9B:
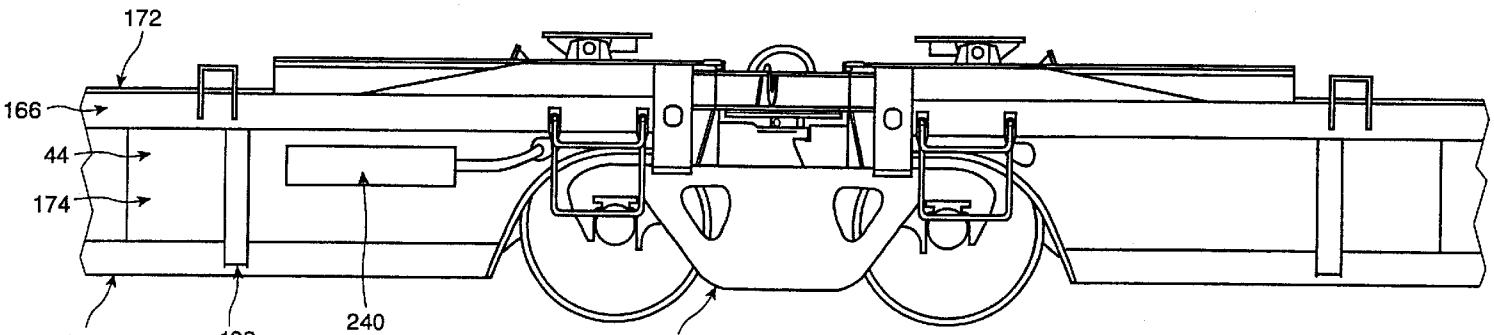
FIG. 9*b* is an enlarged detail, in side view, of an articulated connection of the railcar of FIG. 1*d*.

Referring to FIGS. 8, 9*a* and 9*b*, at each end of railcar unit 22 loads carried in the floor and in the side beam assemblies 42 and 44 are transferred to and from a connector 190. There are three primary load paths. The first load path, generally for carrying vertical shear loads, is from the connector into the webs of a stub sill 192, thence into a bolster 194, or superior cross member 208 to the vertical webs of beam assembly 42 or beam assembly 44. The second load path, generally for carrying lateral loads, is from connector 190 through stub sill 192, through shear plate 196 to bulkhead 197 into a spreader plate 200 and thence through left and right hand struts 88 and 90 into floor assembly 50. The third load path, generally for carrying longitudinal loads, is from connector 190 through stub sill 192, through shear plate 196 to beam assembly 42 or beam assembly 44. A significant portion of the longitudinal loads, perhaps 20 or 30%, is carried from stub sill 192 along a downwardly curving and spreading stub sill neck 198 into a spreader plate 200 and thence through left and right hand struts 88 and 90 into cross member 58 or 60, as the case may be, and into side beam assembly 42 or beam assembly 44. The eccentricity of the buff and draft loads, due to the difference in height of the centroid of the first moment of area of the stub sill from the height of the centroid of the first moment of area of the side beams, is reacted by a couple carried in bulkhead 197 and bolster 194.

Care has been taken on each of these paths to reduce stress concentrations that had formerly been found disadvantageous. On the first path lower side sill 176 and web 174 end at a smoothly curved transition flange 202 which meets main body bolster 194. Similarly, welded to the top of each of side beam assemblies 40 and 42 is a tapered superior transition member 204 which extends from well beyond the transition of web 174 into beam assembly 40 or 42, to the end of beam assembly 40 or 42. This permits a deeper transition section over the wheel well allowance, and a correspondingly better stress distribution. Further, it permits a deeper main bolster 194, and a deeper transition from side beam assemblies 40 and 42 to bolster 194, with lower stress levels generally, permitting a heavier loading generally. At the other end a similar superior transition member 206 carries loads into a cross member 208 at the same level as male or female side bearing arms 210 or 212 and allows those side bearing arms to be at a greater elevation from the rails, permitting a heavier duty articulated truck with greater load bearing capacity.

Figure 10A:
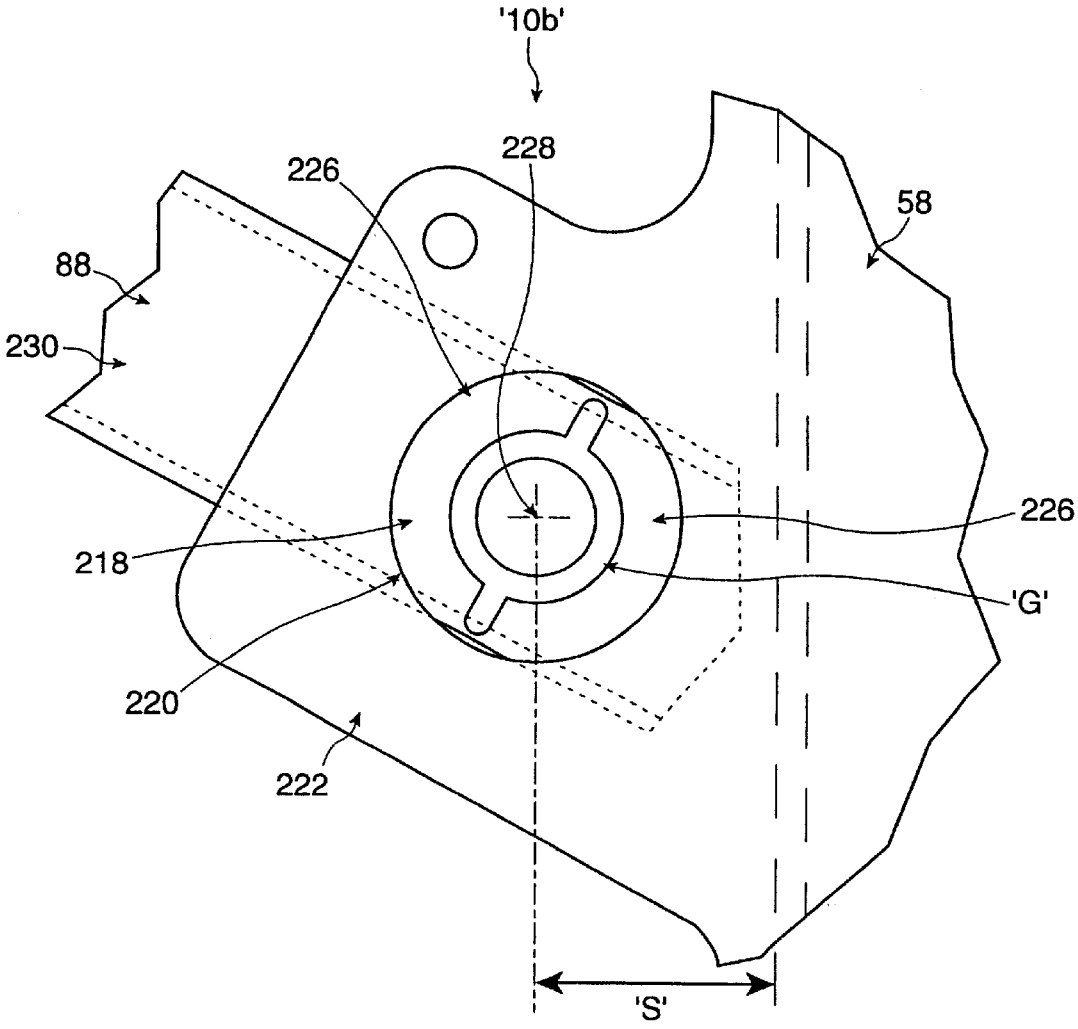
FIG. 10*a* is an enlarged detail of a pin joint assembly taken on Arrow '10*a*' in FIG. 1*b*.
Figure 10B:
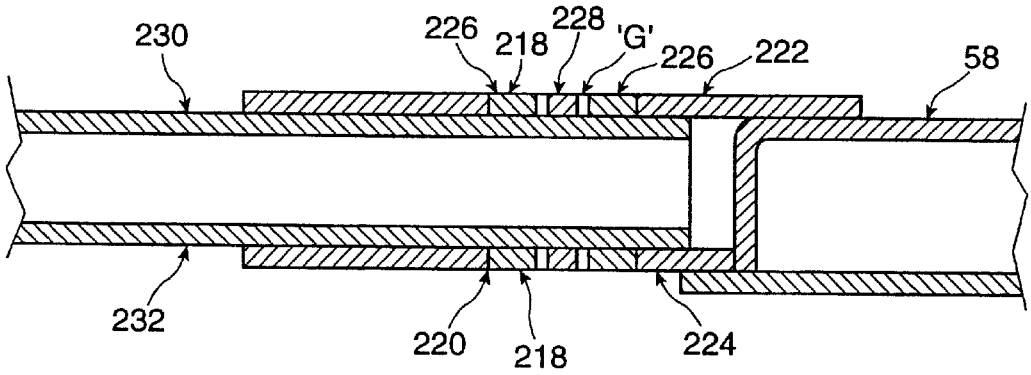
FIG. 10*b* is section of FIG. 10*a* taken on '10*b*—10*b*'.

Along the second load path each of load spreading struts 88 and 90 is pin jointed to prevent them from transmitting a bending moment. The pin joints themselves are of non-conventional construction to carry high loading. As shown in FIGS. 10*a* and 10*b*, each strut has a trunnion 218 built up at each end for capture in apertures 220 of lower and upper sandwich plates 222 and 224. Struts 88 and 90 by themselves have insufficient section to afford a hole for a pin, given the large forces involved. Similarly, a circumferential weld around a stub would lack sufficient weld area. Consequently trunnions 218 are formed from a three part assembly. There are two, opposed, hollow, cylindrical, half-moon shaped outer shells 226 that lie upon the upper, or lower, surface of struts 88 or 90. They are welded inside and out, with externally smoothly ground fillets. Nested inside outer shells 226 is a single inner disc 228 of significantly smaller outer diameter than the inner diameter of shells 226. The gap, or cavity, "G" between shells 226 and disc 228 is filled with repeated passes of weld metal. The area for transfer of shear from the longitudinal top and bottom members 230 and 232 of struts 88 and 90 to their respective trunnions 218 is greatly increased as compared to a single circumferential fillet weld. Further, members 230 and 232 need not be pierced, thus retaining their entire section. Further still, since members 230 and 232 do not have to have enlarged ends, the distance from the centerline of the pin joint to adjacent structure, is less than it might otherwise be.

As noted above, the well car units each have well structures, like end unit well structure 40, that are suitable for carrying shipping containers or highway trailers, or a combination load. Each end of the unit is equipped with a trailer hitch 236 or 238 for receiving the king pin of a highway trailer. The decking adjacent to hitches 236 and 238 is kept clear of obstructions that could interfere with the landing gear, or under-carriage of highway trailers. To accommodate this need, and the need that the distance between brake cylinders not exceed 175 ft., a pair of saddle-bag brake reservoirs 240 and 242 have been partially tucked into the hollow next to the outer face of web 174 beneath top chord roll formed channel 168 and a brake valve 244 has been mounted between units 22 and 24. Reservoir 240 is the normal, or auxiliary brake reservoir for trucks 28 and 32. Reservoir 242 is the corresponding emergency brake reservoir. A standard brake valve 246 and standard combined reservoir 248 are mounted to the connector end of unit 26, and is used for operating the brakes of trucks 30 and 34. The brake piping is arranged to suit this location, but is otherwise conventional in nature.

Figure 11A:
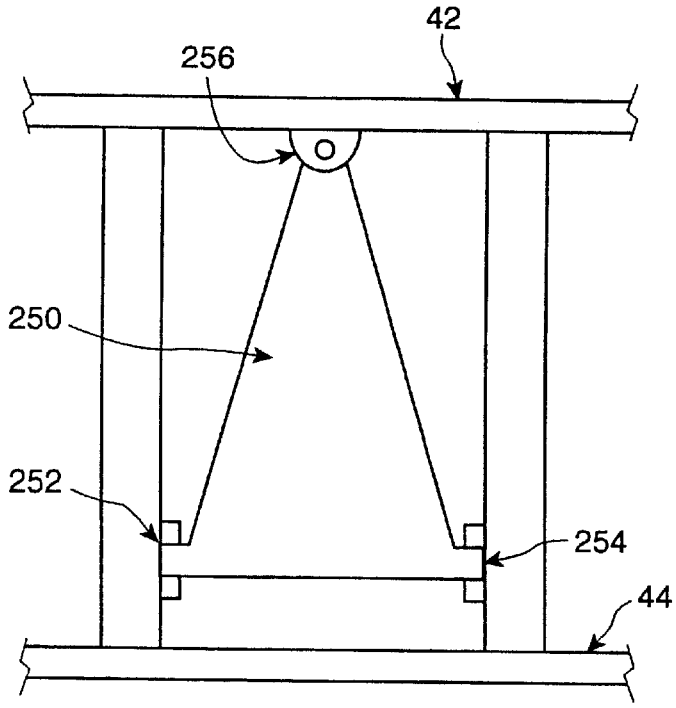
FIG. 11*a* shows an alternative floor panel for the railcar of FIG. 1*c*.
Figure 11B:
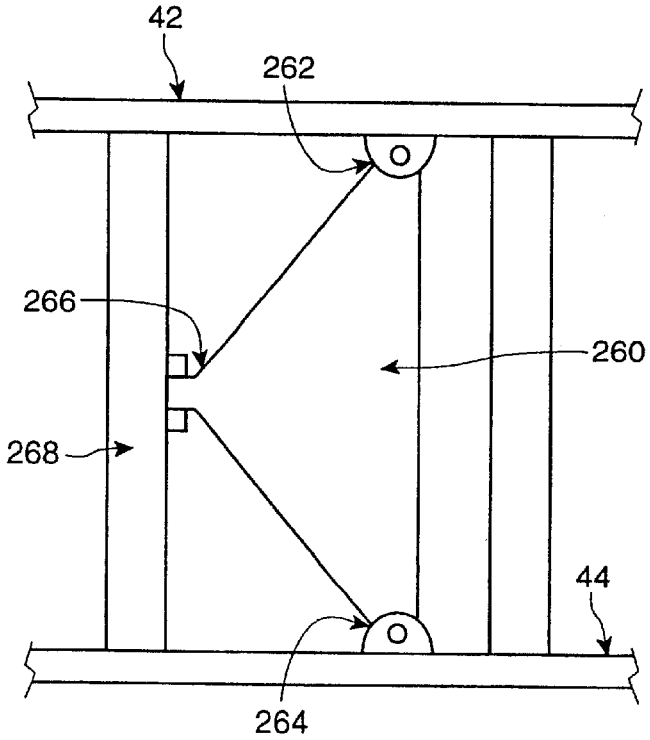
FIG. 11*b* shows a further alternative floor panel for the railcar of FIG. 1*c*.
Figure 11C:
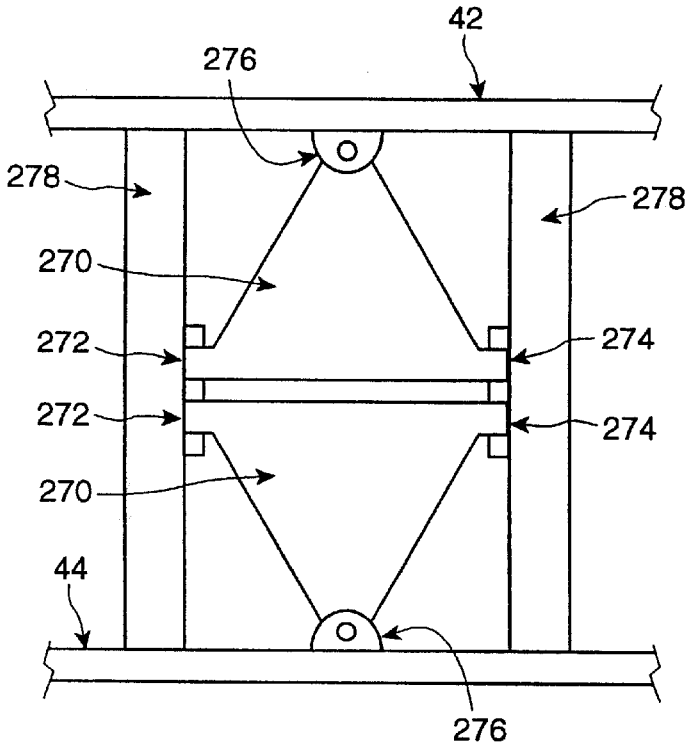
FIG. 11*c* shows a still further alternative floor panel for the railcar of FIG. 1*c*.
Figure 11D:
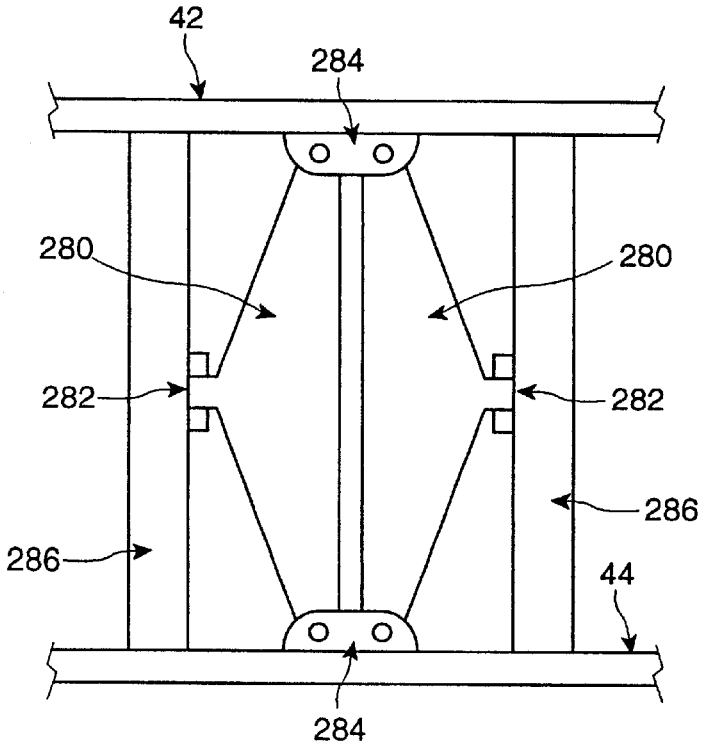
FIG. 11*d* shows yet another further alternative floor panel for the railcar of FIG. 1*c*.

All of the elements of the load paths have now been described in detail. A number of other configurations of floor panel are also possible as illustrated in FIGS. 11*a*, 11*b*, 11*c* and 11*d*. To begin, additional pairs of thrust and reaction blocks could be used rather than one pair per floor panel. Use of a large number of such blocks would yield a dovetailed joint appearance. Other configurations of force resolving floor panel are also possible. For example, it appears that a roughly triangular floor panel 250 could be used, either in a first alternative as shown in FIG. 11*a*, with two sides in slip connections 252 and 254 on opposite cross beams and one side 256 bolted to one side sill, or as in a second alternative, 260 shown in FIG. 11*b*, with opposite sides 262 and 264 bolted to the side sills and one side 266 in a thrust and reaction block joint against one cross beam 268. The common feature of these alternatives is not that they be triangular, but rather that they employ three force transfer interface points, and that those points form a triangle.

In the alternative of FIG. 11*a* the shear will be resolved out of phase. However, two such triangular panels can be placed back-to-back, as in FIG. 11*c*, such that each triangular bolted shear connection transmits a longitudinal force to one side sill. Similarly, a pair of three point force transfer panels can be oriented to lie across the car as in FIG. 11*d*. However, it is preferred to use a four or six point embodiment in which the floor panels are rectangular for carrying highway trailer wheels, and which permit a transverse couple imposed on the floor panels to be reacted by a longitudinal couple in the side sills.

In each case, the force transfer at the thrust and reaction blocks is a purely normal force, applied across a transverse force transfer interface that is in compression. No moment is transmitted across the interface, and no tensile stress is generated to cause a crack to open. The bolted connections to the side sills have good fatigue characteristics: high tensile strength bolts place the flanges in compression. Furthermore, while it is possible to construct floor panels whose longitudinal force transmitting attachments to the respective side sills are not located at the same longitudinal location of the rail car, it is advantageous and preferred, for them to be at the same longitudinal location.

Figure 1C:
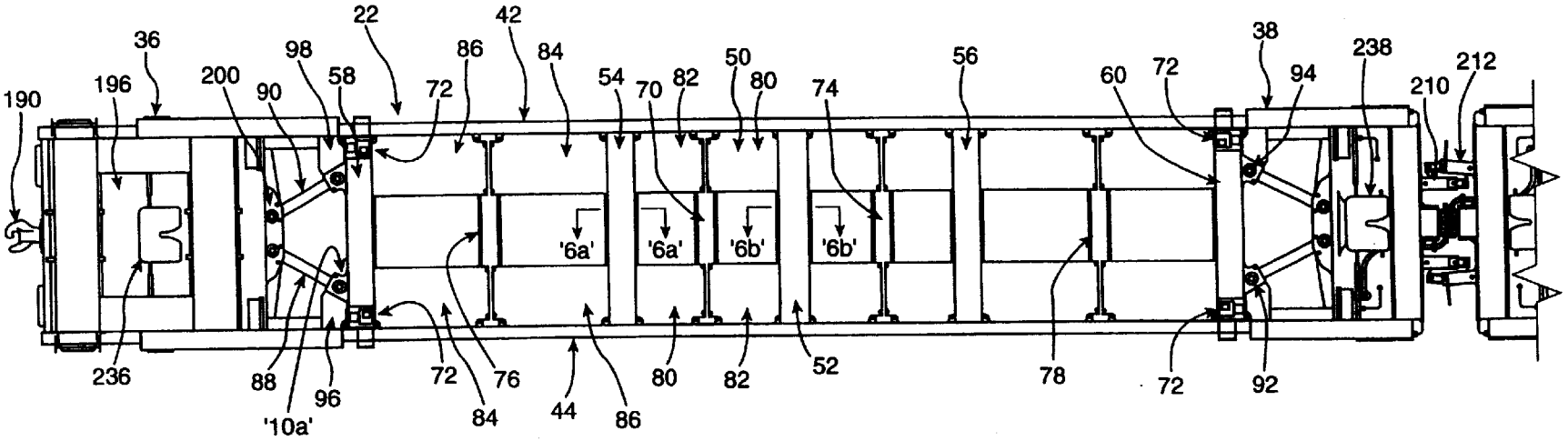
FIG. 1*c* is an enlarged plan view of one end unit of the railcar of FIG. 1*a*.
Figure 1D:
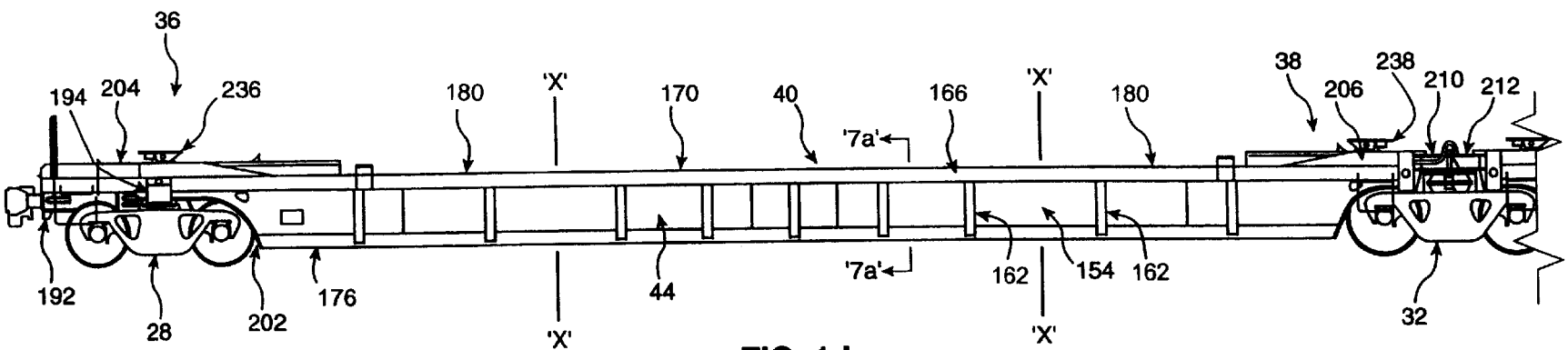
FIG. 1*d* is an enlarged side view of the end unit of FIG. 1*c*.
Figure 2C:
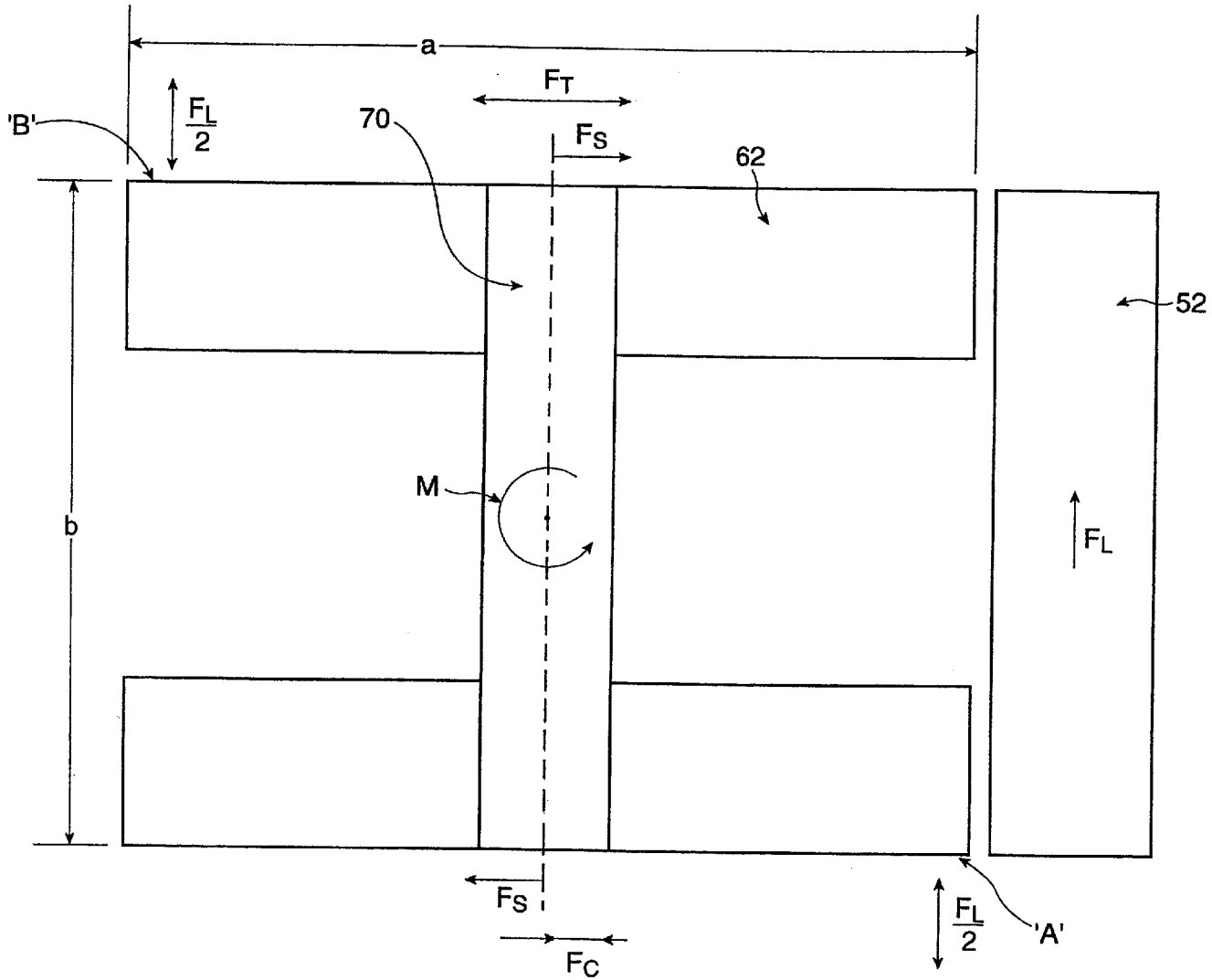
FIG. 2*c* is a load diagram of a floor panel assembly of the loaded end unit of FIG. 1*c*.
Figures 3A, 3B, 3C, 3D:
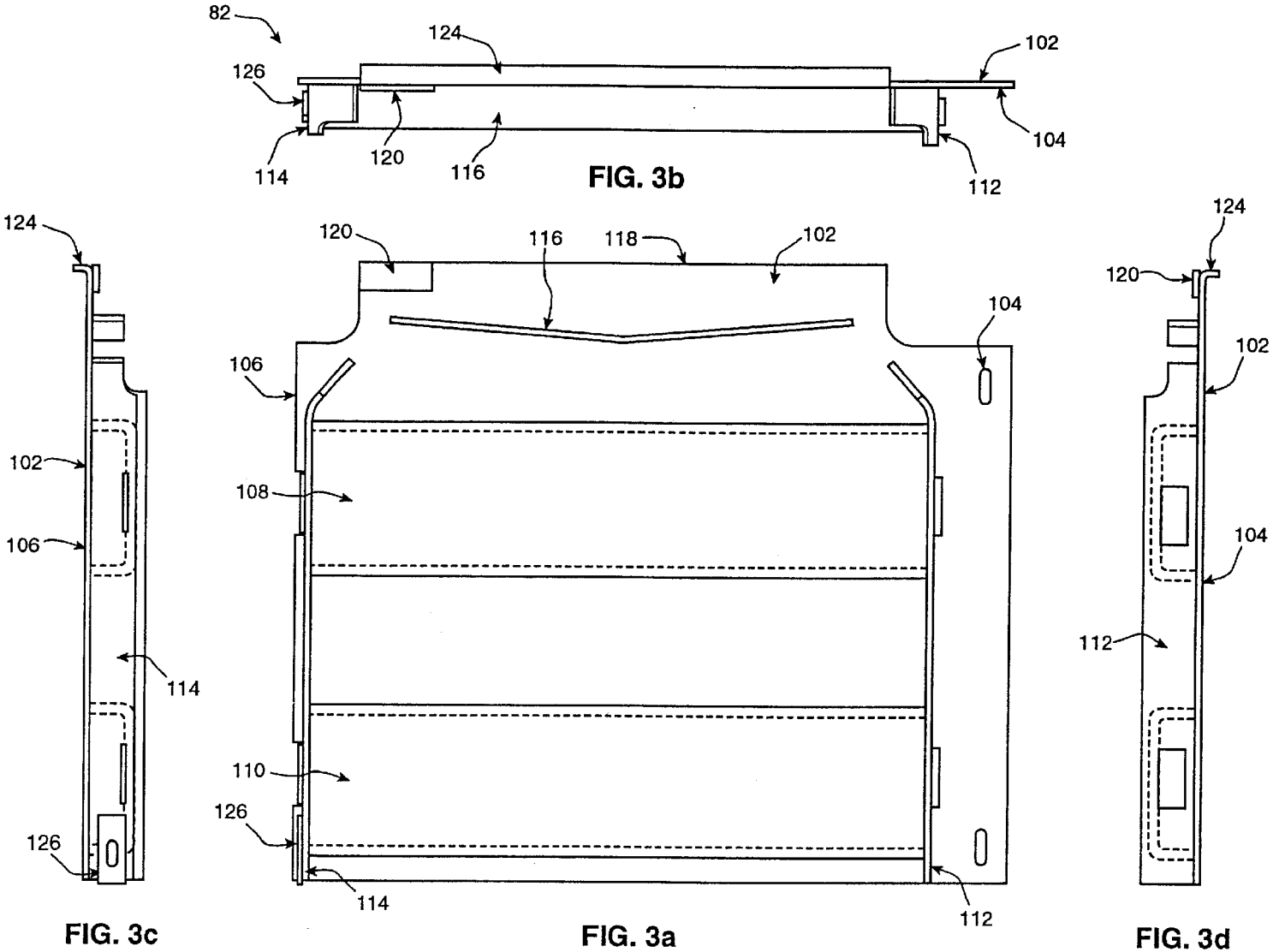
FIG. 3*a* is a view from beneath a floor panel of the end unit of FIG. 1*c*.
FIG. 3*b* is a side view of the floor panel of FIG. 3*a*.
FIG. 3*c* is a view of a free edge of the floor panel of FIG. 3*a*.
FIG. 3*d* is a view of a welded edge of the floor panel of FIG. 3*a*.
Figure 4A:
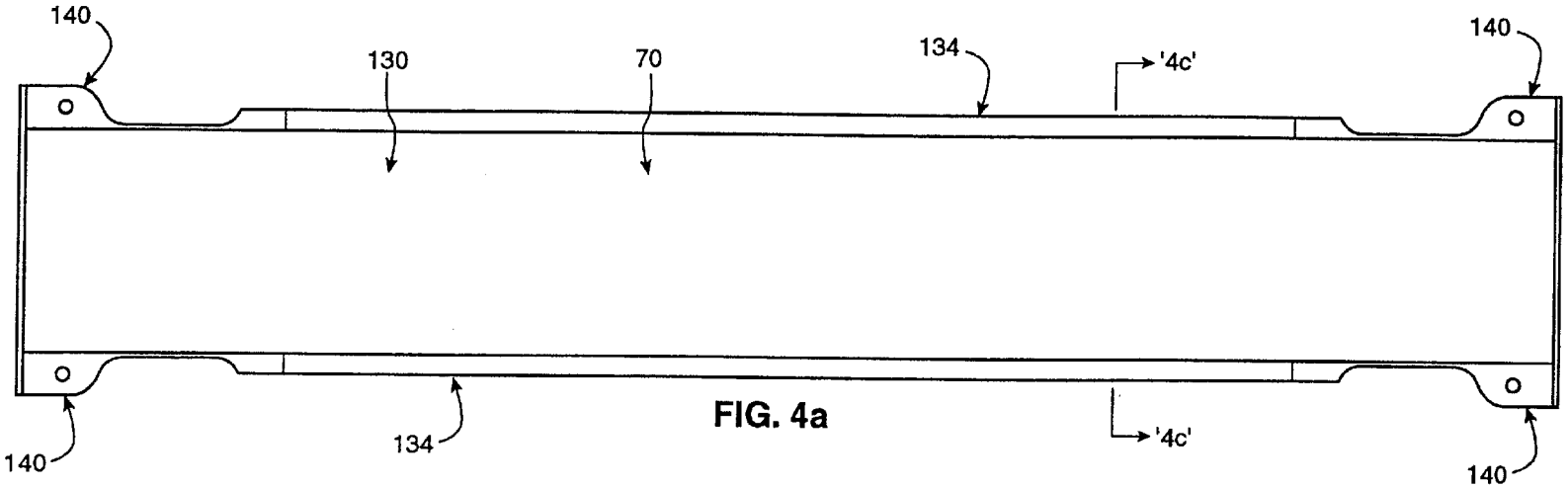
FIG. 4*a* shows a plan view of a moment resolver spine of the end unit of FIG. 1*c*.
Figure 4B:
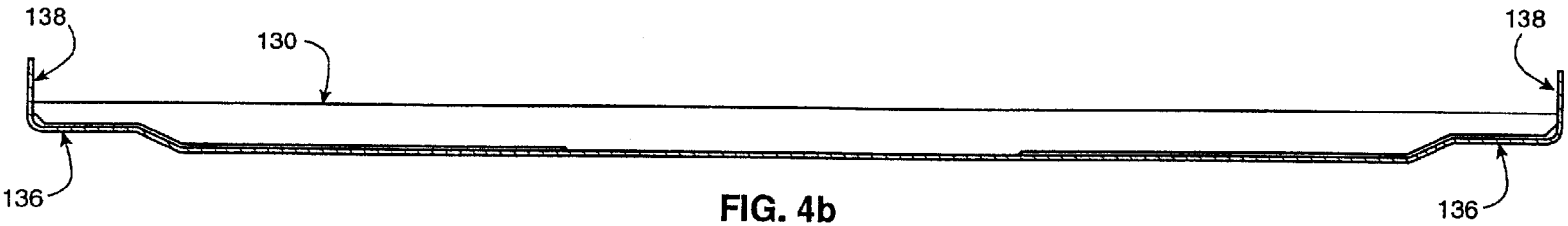
FIG. 4*b* is a side view of the spine of FIG. 4*a*.
Figure 4C:
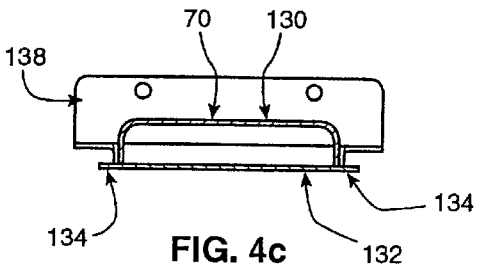
FIG. 4*c* is a cross section of the spine of FIG. 4*a* taken on section '4*c*—4*c*'.
Figure 5A:
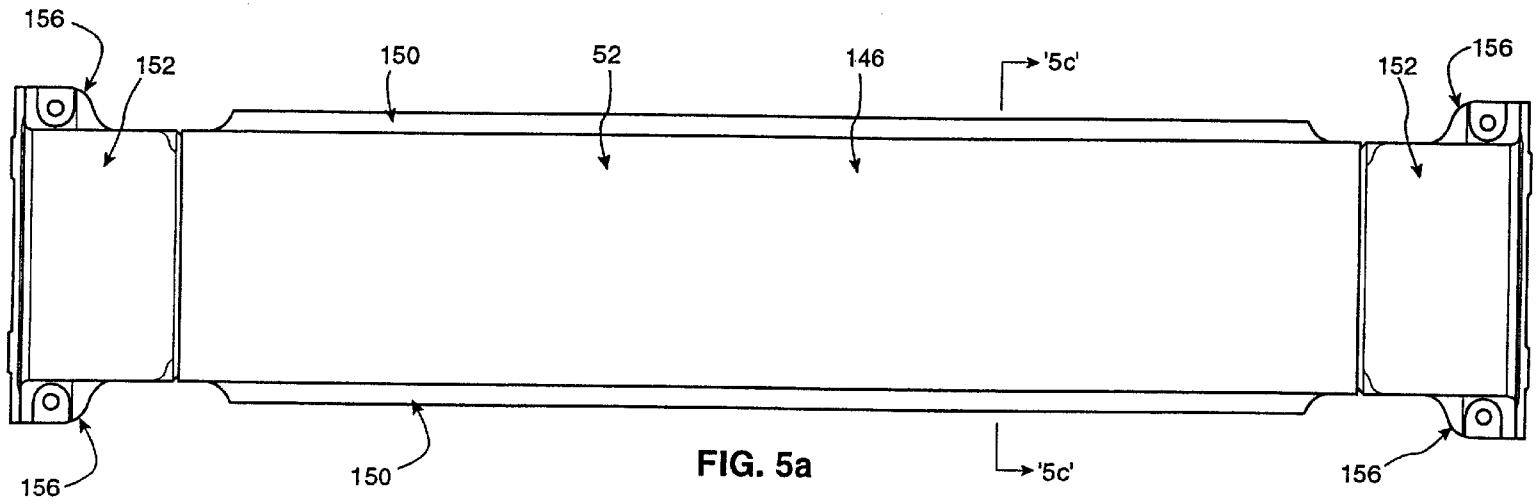
FIG. 5*a* shows a plan view of the central cross beam of the end unit of FIG. 1*c*.
Figure 5B:
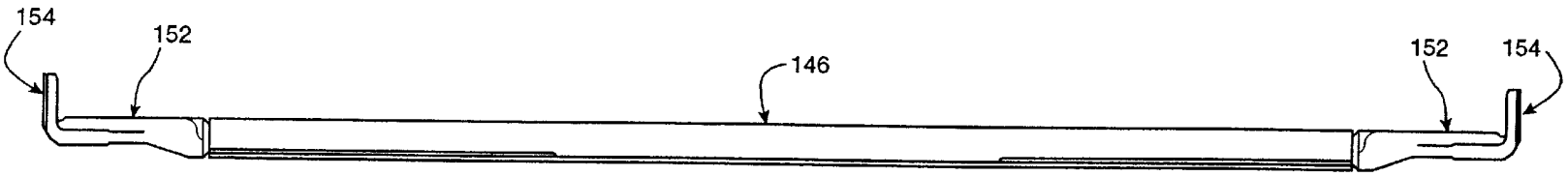
FIG. 5*b* shows a side view of the cross beam of FIG. 5*a*.
Figure 5C:
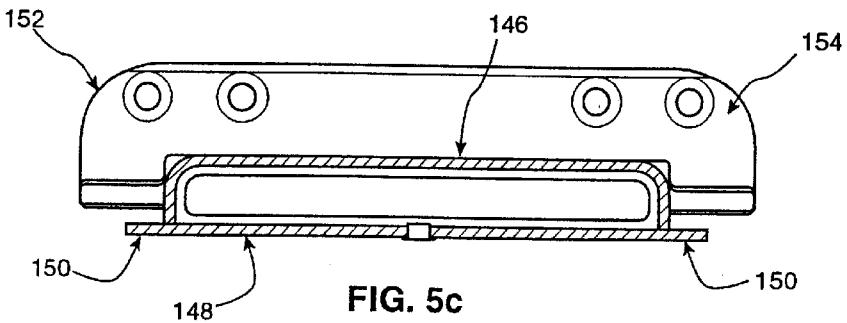
FIG. 5*c* shows a cross section of the cross beam of FIG. 5*a* taken on section '5*c*—5*c*'.

Although the embodiment illustrated in FIG. 1*c* and described above is preferred, the principles of the present invention are not limited to this specific example which is given by way of illustration. It is possible to make other embodiments that employ the principles of the invention and that fall within its spirit and scope as defined by the following claims and their equivalents.

I claim:

1. A rail car comprising:

a pair of first and second side beams, and a pair of first and second end structures;

said end structures being carried by rail car trucks;

said side beams extending in a longitudinal direction between said end structures to define a well for lading therebetween;

said side beams each including a top chord, a lower side sill and a web extending between said top chord and said lower side sill;

at least one transverse cross member attached between the lower side sills of the respective first and second side beams; and said cross member including a monolithic member having a first end, a second end, and a spanning portion extending between said first and second ends;

said first and second ends having respective first and second attachment fittings formed thereat, said first and second attachment fittings being portions of said monolithic member, said first and second attachment fittings being attached to said first and second lower side sills at respective first and second moment connections; and said first and second attachment fittings each including one fitting oriented to be fastened to one of said side beams along a first fastener axis, and another fitting oriented to fasten to that one of said side beams on another fastener axis, said axes extending in different directions.

2. A rail car comprising:

a pair of first and second side beams, and a pair of first and second end structures;

said end structures being carried by rail car trucks;

said side beams extending in a longitudinal direction between said end structures to define a well therebetween;

said side beams each including a top chord, a lower side sill and a web extending between said top chord and said lower side sill;

at least one cross member extending in a transverse direction between the lower side sills of the respective first and second side beams; and said cross member including a monolithic member having a first end, a second end, and a spanning portion extending between said first and second ends;

said first and second ends having respective first and second attachment fittings formed thereat, said first and second attachment fittings being portions of said monolithic member, said first attachment fitting being attached to said first lower side sill and said second attachment fitting being attached to said second lower side sill;

each said lower side sill having an upwardly extending leg portion and a laterally inwardly extending toe;

said first attachment fitting having a first portion formed to mate with the upwardly extending leg portion of said first lower side sill;

said first attachment fitting having a second portion formed to locate above the laterally inwardly extending toe of said first lower side sill; and said first attachment fitting having bores defined therein to permit said first attachment fitting to be fastened to said first side beam.

3. The rail car of claim 2, wherein a floor panel is welded to said cross member.

4. The rail car of claim 2, wherein the first side beam has an upwardly extending stiffener mounted adjacent to said cross member.

5. The rail car of claim 2, wherein said first portion of said first attachment fitting includes a first flange having one of said bores defined therein to permit said first flange to be fastened to the upwardly extending leg portion of the lower side sill.

6. The rail car of claim 5, wherein said spanning portion has an upwardly facing surface lying in a horizontal plane, and said first flange extends upwardly of said horizontal plane.

7. The rail car of claim 5, wherein said one of said bores defined in said first flange is a horizontal bore through which to fasten said first flange to the upwardly extending leg portion of the first lower side sill.

8. The rail car of claim 2, wherein said second portion of said first attachment fitting includes a flange for mating engagement with the laterally inwardly extending toe of the first lower side sill.

9. The rail car of claim 2, wherein:

said first portion of said first attachment fitting includes a first flange having one of said bores defined therein to permit said first flange to be fastened to the upwardly extending leg portion of the first side sill; and said second portion of said first attachment fitting includes a second flange having another of said bores defined therein to permit said second flange to be fastened to the laterally inwardly extending toe of the first side sill.

10. The rail car of claim 9, wherein said second portion of said first attachment fitting includes a third flange having a further one of said bores defined therein to permit said third flange to be fastened to said laterally inwardly extending toe of the first lower side sill.

11. The rail car of claim 2, wherein:

said first portion of said first attachment fitting includes a first flange, said first flange having a first face for contacting the upwardly extending leg portion of the first lower side sill, said first face lying in a vertical plane and having some of said bores defined therein to permit said first flange to be fastened to the upwardly extending leg portion of the first lower side sill; and said second portion of said first attachment fitting includes a second flange having a second face for mating engagement with the laterally inwardly extending toe of said first lower side sill, said second face lying in a horizontal plane.

12. The rail car of claim 11, wherein said bores defined in said first flange have horizontal axes, and said horizontal axes of said bores are offset upwardly from said horizontal plane of said second face of said second flange.

13. The rail car of claim 11, wherein said second flange has a bore defined therein to permit said second flange to be fastened to the laterally inward extending toe of said first lower side sill, said bore in said second flange has a vertical axis, and said vertical axis of said bore in said second flange is horizontally offset laterally inboard of the vertical plane of said first face of said first flange.

14. The rail car of claim 11, wherein:

said bores defined in said first flange have horizontal axes, and said horizontal axes of said bores re offset upwardly from said horizontal plane of said second face of said second flange; and said second flange as a bore defined therein to permit said second flange to be bolted to the laterally inward extending toe of said first lower side sill, said bore in said second flange has a vertical axis, and said vertical axis of said bore in said second flange is horizontally offset laterally inboard of the vertical plane of said first face of said first flange.

15. The rail car of claim 10, wherein said second flange meets said first flange at a first corner, and said third flange meets said first flange at a second corner.

16. The rail car of claim 10, wherein said second and third flanges each have a face for contacting said laterally inwardly extending toe of said first lower side sill, and said respective faces are co-planar.

17. The rail car of claim 15, wherein said second and third flanges extend away from said first and second corners respectively and toward said second end of said monolithic member.

18. The rail car of claim 17, wherein said second attachment fitting is the same as said first attachment fitting.

19. The rail car of claim 2, wherein:

a cover plate is mounted to said monolithic member to form a compound beam;

a portion of said cover plate forms a first flange portion of said compound beam;

a portion of said monolithic member forms a second flange portion of said compound beam; and said second flange portion is spaced from said first flange portion, said first and second flange portions being co-operable to resist flexure of said cross member.

20. The rail car of claim 19, wherein:

said cover plate has a back member and first and second toes extending away therefrom to define a channel having a U-shaped cross-section; and each of said toes is attached to a said monolithic member to form a closed hollow section.

21. The rail car of claim 20 wherein said cover plate has a first end attached to said first end fitting of said monolithic member, and a second end attached to said second end fitting of said monolithic member.

22. The rail car of claim 20, wherein the monolithic member has a first downward step and a second downward step formed therein, each of said first and second steps located laterally inboard of said toes of the lower side sills when said cross member is attached to said first and second side sills, said spanning portion lying between said first and second downward steps.

23. The rail car of claim 22, wherein said toes of said cover plate each have a profiles cut to conform to said steps.

24. The rail car of claim 20, wherein:

said monolithic member has a length between said first and second ends and a width perpendicular to said length;

said U-shaped channel has a width; and the width of said U-shaped channel is less than said width of said monolithic member, said monolithic member having margins extending beyond said cover.

25. The rail car of claim 1 wherein:

each of said lower side sills has an upwardly extending leg portion and a laterally inwardly extending toe;

said first attachment fitting has a first portion formed to mate with the upwardly extending leg portion of said lower side sill of said first side beam;

said first attachment fitting has a second portion formed to locate above the laterally inwardly extending toe of said lower side sill of said first side beam; and said first attachment fitting has bores defined therein to permit said first attachment fitting to be bolted to said first side beam;

said second attachment fitting has a first portion formed to mate with the upwardly extending leg portion of said lower side sill of said second side beam;

said second attachment fitting has a second portion formed to locate above the laterally inwardly extending toe of said lower side sill of said second side beam; and said second attachment fitting has bores defined therein to permit said second attachment fitting to be bolted to said second side beam;

said first portion of said first attachment fitting includes a first flange portion matable with said first side beam; and said first portion of said second attachment fitting includes a first flange portion matable with said second side beam.

26. A cross member for a rail road well car, the rail road well car having a pair of first and second side beams, and a pair of first and second end structures, the side beams extending in a longitudinal direction between the end structures to define a well for lading therebetween, the side beams each including a top chord, a lower side sill and a web extending between the top chord and the lower side sill, each of the lower side sills having an upwardly extending leg portion and a laterally inwardly extending toe, wherein said cross member comprises:

a monolithic member having a first end, a second end, and a spanning portion extending between said first and second ends;

said first and second ends having respective first and second moment connection attachment fittings formed thereat, said first and second moment connection attachment fittings being portions of said monolithic member, said;

said first moment connection attachment fitting being attachable to the lower side sill of the first side beam to form a first moment connection therewith, and said second moment connection attachment fitting being attachable to the lower side sill of the second side beam to form a second moment connection therewith, said moment connections being moment connections; and said first and second attachment fittings each including one fitting oriented to be fastened to one of said side beams along a first fastener axis, and another fitting oriented to fasten to that one of said side beams on another fastener axis, said axis extending in different directions.

27. A cross member for a rail road well car, the rail road well car having a pair of first and second side beams, and a pair of first and second end structures, the side beams extending in a longitudinal direction between the end structures to define a well for lading therebetween, the side beams each including a top chord, a lower side sill and a web extending between the top chord and the lower side sill, each of the lower side sills having an upwardly extending leg portion and a laterally inwardly extending toe, wherein said cross member comprises:

a monolithic member having a first end, a second end, and a spanning portion extending between said first and second ends;

said first and second ends having respective first and second attachment fittings formed thereat, said first and second attachment fittings being portions of said monolithic member;

said first attachment fitting being attachable to the lower side sill of the first side beam, and said second attachment fitting being attachable to the lower side sill of the second side beam;

said first attachment fitting having a first portion formed to mate with the upwardly extending leg portion of the lower side sill of the first side beam;

said first attachment fitting having a second portion formed to locate above the laterally inwardly extending toe of the lower side sill of the first side beam; and said first attachment fitting having bores defined therein to permit said first attachment fitting to be fastened to the first side beam.

28. The cross member of claim 27, wherein said cross member has a floor panel welded thereto.

29. The cross member of claim 27, wherein said first portion of said first attachment fitting includes a first flange having one of said bores defined therein to permit said first flange to be bolted to the upwardly extending leg portion of the lower side sill of the first side beam.

30. The cross member of claim 29, wherein said spanning portion has an upwardly facing surface lying in a plane, and said first flange extends upwardly of said plane.

31. The cross member of claim 27, wherein one of said bores is a horizontal bore defined in said firs flange to permit said first flange to be fastened to the upwardly extending leg portion of the lower side sill of the first side beam.

32. The cross member of claim 27, wherein said second portion of said first attachment fitting includes a flange for mating engagement with the laterally inwardly extending toe of the lower side sill of the first side beam.

33. The cross member of claim 27, wherein:

said first portion of said first attachment fitting includes a first flange having one of said bores defined therein to permit said first flange to be fastened to the upwardly extending leg portion of the lower side sill of the first side beam; and said second portion of said first attachment fitting includes a second flange having another of said bores defined therein to permit said second flange to be fastened to the laterally inwardly extending toe of the lower side sill of the first side beam.

34. The cross member of claim 33, wherein said second portion of said first attachment fitting includes a third flange having a further one of said bores defined therein to permit said third flange to be fastened to the laterally inwardly extending toe of the lower side sill of the first side beam.

35. The cross member of claim 27, wherein:

said first portion of said first attachment fitting includes a first flange, said first flange having a first face for contacting the upwardly extending leg portion of the lower side sill of the first side beam, said first face lying in a vertical plane and having one of said bores defined therein to permit said first flange to be fastened to the upwardly extending leg portion of the lower side sill of the first side beam; and said second portion of said first attachment fitting includes a second flange having a second face lying in a horizontal plane for mating engagement with the laterally inwardly extending toe of the lower side sill of the first side beam.

36. The cross member of claim 35, wherein said one of said bores defined in said first flange has an horizontal axis, and said horizontal axis of said one of said bores is offset upwardly from said horizontal plane of said second face of said second flange.

37. The cross member of claim 35, wherein said second flange has another of said bores defined therein to permit said second flange to be fastened to the laterally inward extending toe of the lower side sill of the first side beam, said bore in said second flange has a vertical axis, and said vertical axis of said bore in said second flange is horizontally offset laterally inboard of the vertical plane of said first face of said first flange.

38. The cross member of claim 35, wherein:

said first flange has more than one of said bores defined therein;

said bores defined in said first flange have horizontal axes, and said horizontal axes of said bores are offset upwardly from said horizontal plane of said second face of said second flange; and said second flange has another of said bores defined therein to permit said second flange to be bolted to the laterally inward extending toe of the lower side sill of the first side beam;

said bore in said second flange has a vertical axis; and said vertical axis of said bore in said second flange is horizontally offset laterally inboard of the vertical plane of said first face of said first flange.

39. The cross member of claim 34, wherein said second flange meets said first flange at a first corner, and said third flange meets said first flange at a second corner.

40. The cross member of claim 34, wherein said second and third flanges each have a face for contacting said laterally inwardly extending toe of the lower side sill of the first side beam, and said respective faces are co-planar.

41. The cross member of claim 39, wherein said second and third flanges extend away from said first and second corners respectively and toward said second end of said monolithic member.

42. The cross member of claim 41, wherein said second attachment fitting is the same as said first attachment fitting.

* * * * *

UNITED STATES PATENT AND TRADEMARK OFFICE

CERTIFICATE OF CORRECTION

PATENT NO. : 6,584,912 B2
DATED : July 1, 2003
INVENTOR(S) : Forbes, James W.

It is certified that error appears in the above-identified patent and that said Letters Patent is hereby corrected as shown below:

Column 6,
Line 44, delete "M=a(FL/2)" and insert -- M=a(FL/2) --.
Line 53, delete "FT" and insert -- FT --.
Line 54, delete "FC" and insert -- FC --.

Column 13,
Line 41, delete "re" and insert -- are --.
Line 44, delete "as" and insert -- has --.

Column 16,
Line 5, delete "firs" and insert -- first --.

Signed and Sealed this

Twenty-second Day of June, 2004

JON W. DUDAS
*Acting Director of the United States Patent and Trademark Office*